US009423194B2

(12) United States Patent
Fritz et al.

(10) Patent No.: US 9,423,194 B2
(45) Date of Patent: Aug. 23, 2016

(54) REDESIGNED AR-15 UPPER RECEIVER

(71) Applicants: Craig A. Fritz, Boyd, WI (US); Barry D. Laffe, Humbird, WI (US)

(72) Inventors: Craig A. Fritz, Boyd, WI (US); Barry D. Laffe, Humbird, WI (US)

( * ) Notice: Subject to any disclaimer, the term of this patent is extended or adjusted under 35 U.S.C. 154(b) by 0 days.

(21) Appl. No.: 14/291,723

(22) Filed: May 30, 2014

(65) Prior Publication Data

US 2014/0352191 A1 Dec. 4, 2014

Related U.S. Application Data

(60) Provisional application No. 61/829,700, filed on May 31, 2013.

(51) Int. Cl.
*F41A 3/66* (2006.01)
*F41A 5/18* (2006.01)

(52) U.S. Cl.
CPC .... *F41A 3/66* (2013.01); *F41A 5/18* (2013.01)

(58) Field of Classification Search
CPC ..... F41A 3/66; F41A 5/00; F41A 5/18; F41A 21/48; F41A 21/482
See application file for complete search history.

(56) References Cited

U.S. PATENT DOCUMENTS

| | | | | |
|---|---|---|---|---|
| 8,141,285 | B2 * | 3/2012 | Brown | 42/71.01 |
| 8,910,406 | B1 * | 12/2014 | Huang et al. | 42/16 |
| 2010/0319231 | A1 * | 12/2010 | Stone et al. | 42/71.01 |
| 2012/0102805 | A1 * | 5/2012 | Buxton | 42/90 |
| 2013/0205637 | A1 * | 8/2013 | Patel | 42/75.02 |
| 2013/0219763 | A1 * | 8/2013 | Nunes | 42/16 |
| 2014/0000142 | A1 * | 1/2014 | Patel | 42/14 |
| 2014/0075814 | A1 * | 3/2014 | Larson et al. | 42/72 |
| 2014/0076146 | A1 * | 3/2014 | Gomez | 89/191.01 |
| 2014/0115938 | A1 * | 5/2014 | Jarboe | 42/71.01 |
| 2014/0260943 | A1 * | 9/2014 | Alis | 89/154 |

* cited by examiner

*Primary Examiner* — Joshua Freeman

(57) ABSTRACT

A redesigned upper receiver for the AR-15 upper receiver has a cylindrical housing, a barrel mount, and a stock mounting point. The barrel mount and the stock mounting point are positioned on opposite ends of the cylindrical housing. The AR-15 gun barrel is connected to the barrel mount. The charge carrier is inserted to the upper receiver through the stock mounting point. The barrel mount has a tubular body, a gas tube slot, a pin locking slot, an internal threading, and an external threading. The radius of the tubular body is larger than the cylindrical housing. The AR-15 gun barrel is secured within the internal threading. The gas tube is inserted to the gas tube slot. The hand guard is threaded onto the external threading of the upper receiver.

11 Claims, 7 Drawing Sheets

REDESIGNED AR-15 UPPER RECEIVER

The current application claims a priority to the U.S. Provisional Patent application Ser. No. 61/829,700 filed on May 31, 2013.

FIELD OF THE INVENTION

The present invention relates generally to the field of semi-automatic rifles. More specifically, the present invention is a redesigned upper receiver for the AR-15 rifle.

BACKGROUND OF THE INVENTION

The AR-15 was first built as a small arms rifle for the United States armed forces. Later on, the AR-15 was made available for civilian sales in 1963. As in most rifles, the AR-15 uses an operation mechanism called direct gas impingement, in which gas from a fired cartridge is directly guided to the bolt carrier or slide assembly to cycle the action. The AR-15 is designed such that one upper receiver can quickly and easily be substituted for another. Therefore, the upper receiver can incorporate barrels of different weights, lengths, and calibers.

The barrel of the AR-15 is attached to the front end of the upper receiver. The attachment point on the standard upper receiver is considerably thin and is prone to cracking. As a result of the lack of strength, parts need to be replaced on a regular basis. Once the barrel is placed within the upper receiver, the position of the barrel is secured by the barrel nut. The gas system is attached afterwards. In doing so, the gas tube of the gas system is inserted through a slot in the barrel nut. Therefore, when the barrel needs to be changed, the entire gas system and the barrel nut needs to be removed. The process of removing the gas system and the barrel nut can be time consuming and stressful. The time consuming nature of the process can be disadvantageous to an individual who disassembles AR-15s on a regular basis. Furthermore, due to the thin attachment point provided on a standard AR-15, repeated changing of barrels can affect life span of the weapon due to cracking. The tedious process of aligning and tightening of components needs to be repeated since the entire gas system is removed along with the barrel. As a result of the repeated use, even the components that were not replaced wear off to some extent.

The objective of the present invention is to address the aforementioned issues. The effective design of the present invention allows a user to conveniently interchange the barrel. As mentioned earlier, the barrel of a standard AR-15 is secured using a barrel nut. Instead of securing the barrel with the use of a barrel nut, the present invention allows the barrel to be securely positioned within the body of the upper receiver. More specifically, the present invention uses an internal barrel nut. Instead of being connected to the barrel nut, the gas tube is separately connected to the upper receiver which allows the barrel to be removed and changed without interrupting the gas system. Additionally, it has been experimentally proven that the present invention is flexible, durable, and reliable under the harshest conditions.

DETAIL DESCRIPTIONS OF THE INVENTION

All illustrations of the drawings are for the purpose of describing selected versions of the present invention and are not intended to limit the scope of the present invention.

The present invention is a redesigned upper receiver for the AR-15 semi-automatic rifle. The present invention provides more strength to the barrel mount and also eliminates the need to remove the gas system when switching barrels. Furthermore, the redesigned upper receiver has a series of other advantages. The convenience in cleaning, the ability to remove and clean the barrel extension in a short time period, the rigidity, higher accuracy levels and the ability to receive a variety of barrels are some notable advantages.

Figure 1:
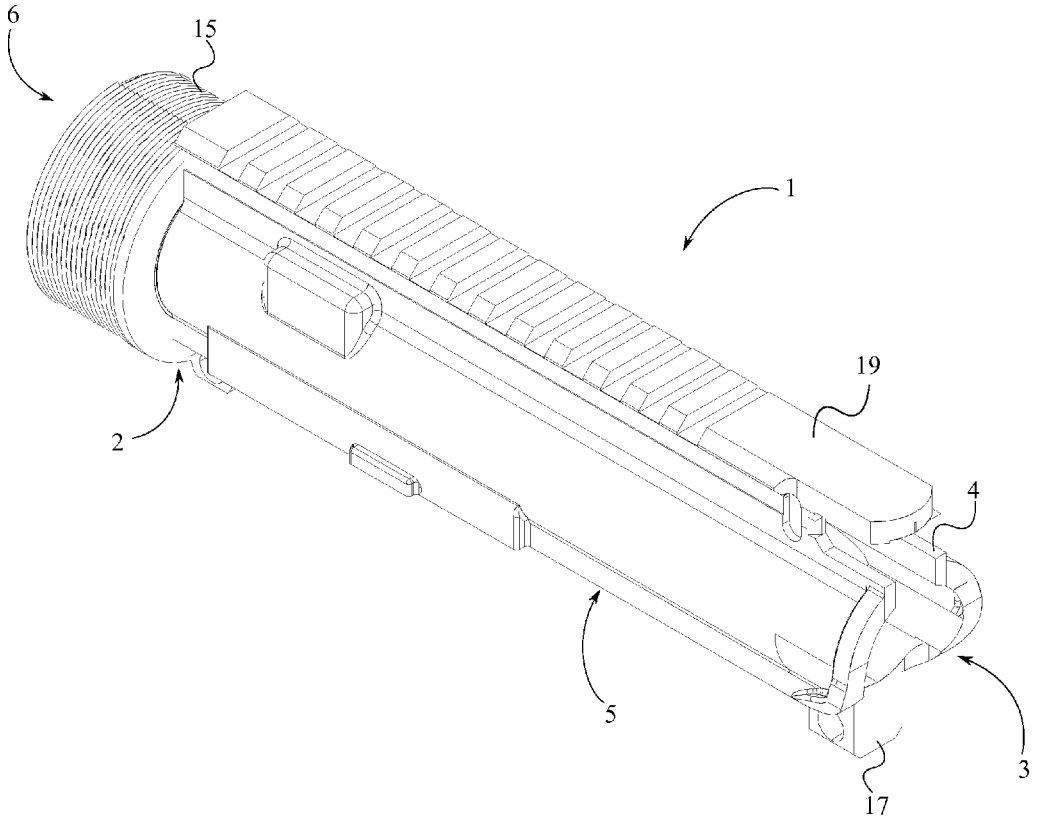
FIG. 1 is an isometric view of the present invention.
Figure 2:
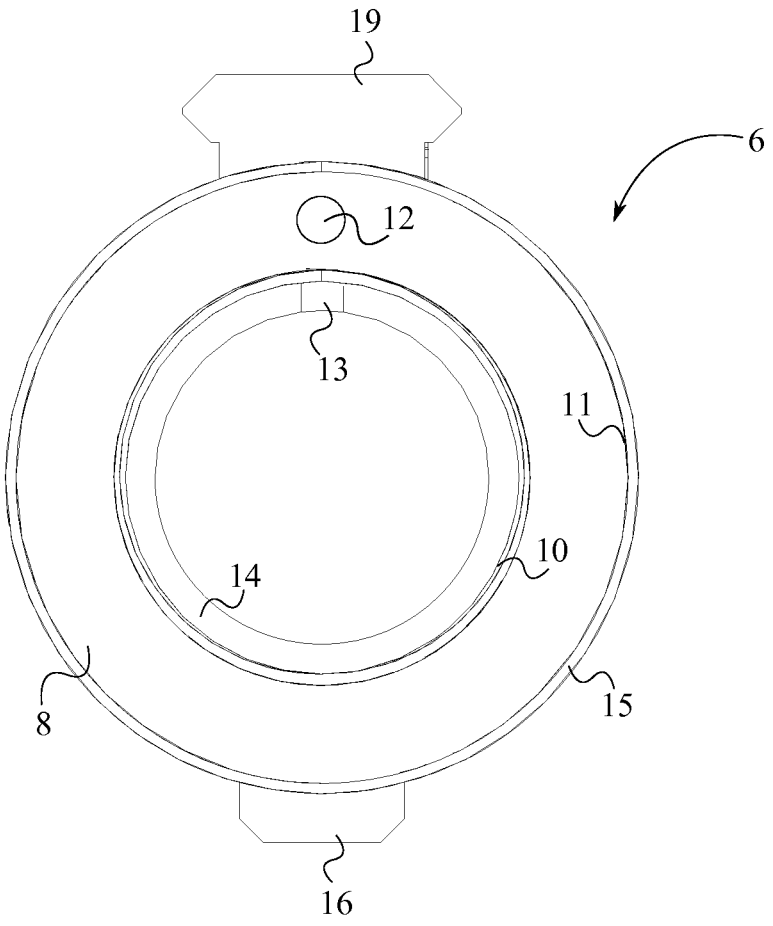
FIG. 2 is a front view of the present invention.
Figure 3:
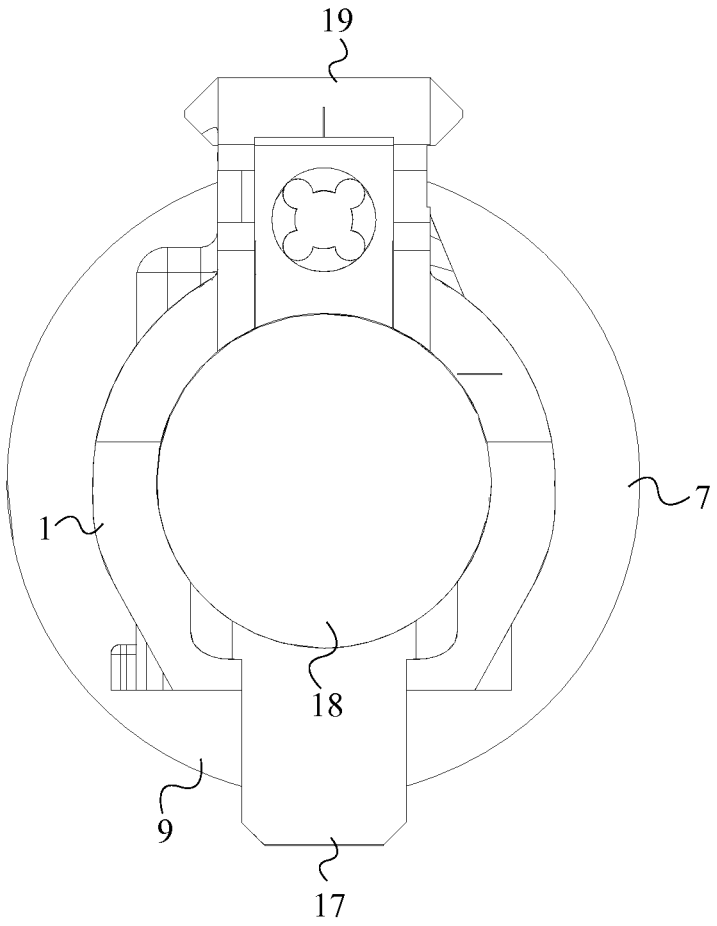
FIG. 3 is a rear view of the present invention.

As seen in FIGS. 1, 2, and 3, the present invention comprises a cylindrical housing 1, a barrel mount 6, a first lower-receiver attachment point 16, a second lower-receiver attachment point 17, a stock mounting point 18, and a Picatinny-style rail 19. The barrel mount 6 and the stock mounting point 18 are positioned on opposite ends of the cylindrical housing 1. The barrel mount 6 receives the AR-15 gun barrel. The charge carrier is inserted to the upper receiver through the stock mounting point 18. The first lower-receiver attachment point 16 and the second lower-receiver attachment point 17 connect the upper receiver to the lower receiver. The Picatinny-style rail 19 provides a standard mounting platform for accessories and attachments.

The cylindrical housing 1 comprises a front housing base 2, a rear housing base 3, a top lateral surface 4, and a bottom lateral surface 5. The front housing base 2 and the rear housing base 3 are positioned on opposite ends of the cylindrical housing 1. In particular, the front housing base 2 is connected to the barrel mount 6. Similarly, the rear housing base 3 is connected to the stock mounting point 18. The top lateral surface 4 and the bottom lateral surface 5 are similar to the traditional AR-15 upper receivers. Moreover, the top lateral surface 4 receives the gas tube of the gas system and the bottom lateral surface 5 contains a means to secure the upper receiver with the lower receiver.

The AR-15 gun barrel connects to the barrel mount 6. As illustrated in FIG. 2, the barrel mount 6 comprises a tubular body 7, a gas tube slot 12, a pin locking slot 13, an internal threading 14, and an external threading 15. The tubular body 7 is designed to receive the AR-15 gun barrel. Traditional AR-15 gun barrels contain a pin in order to align the barrel with the upper receiver. The alignment pin on the AR-15 gun barrel is secured within the pin locking slot 13. Afterwards, the AR-15 gun barrel is secured within the tubular body 7 utilizing the provided external barrel nut and the internal threading 14.

Traditionally, the gas tube is inserted into the barrel nut. The barrel nut is replaced by the tubular body 7 such that the gas tube can be inserted to the gas tube slot 12. The hand guard is traditionally secured to the outer threading of the barrel nut. Since the barrel nut is replaced by the tubular body 7, the hand guard is fastened onto the external threading 15 illustrated in FIG. 4.

Figure 4:
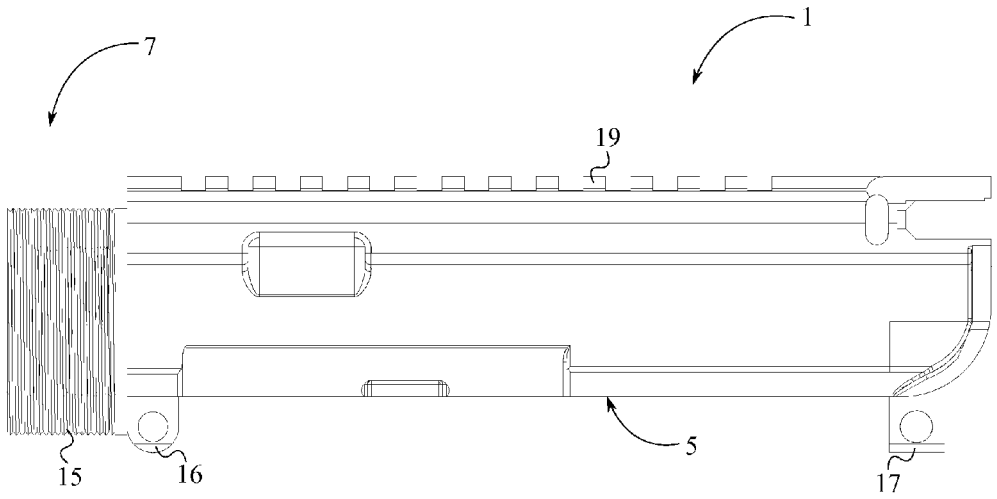
FIG. 4 is a left side view of the present invention.
Figure 5:
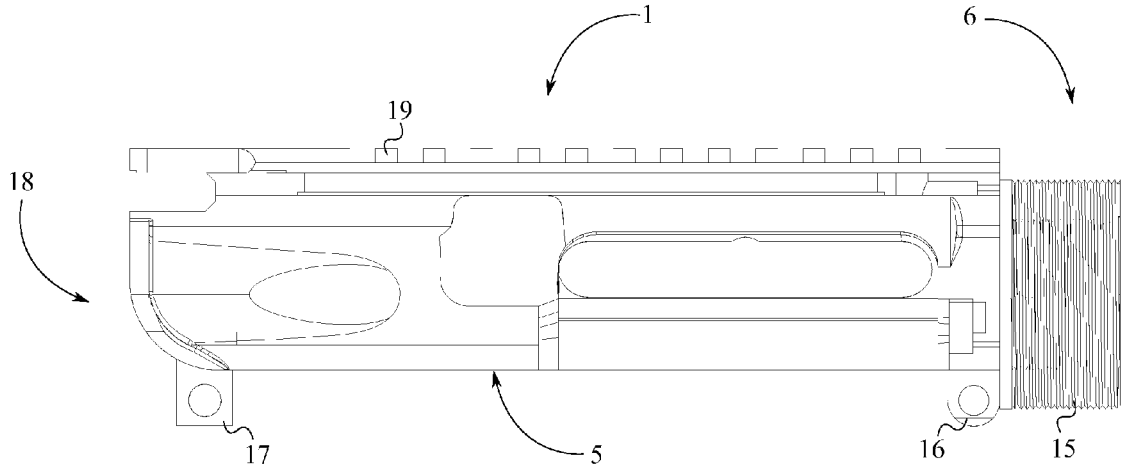
FIG. 5 is a right side view of the present invention.
Figure 6:
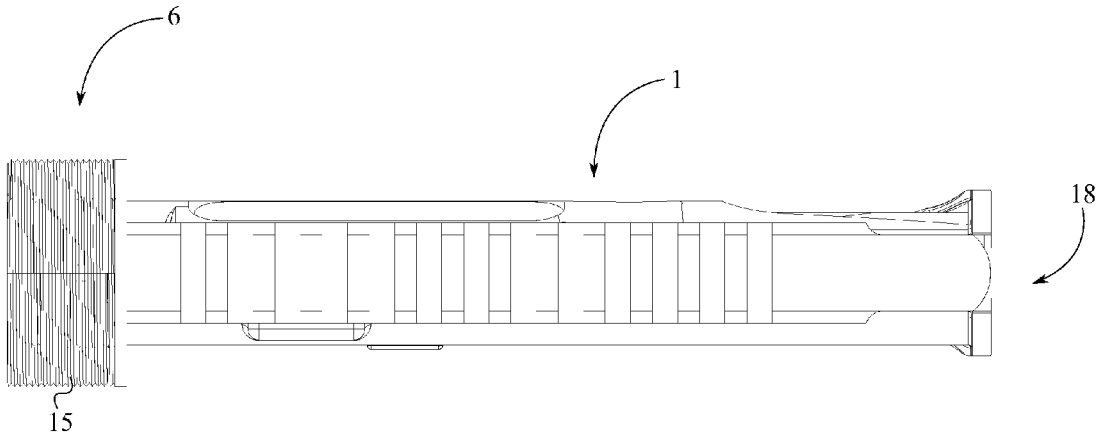
FIG. 6 is a top view of the present invention.
Figure 7:
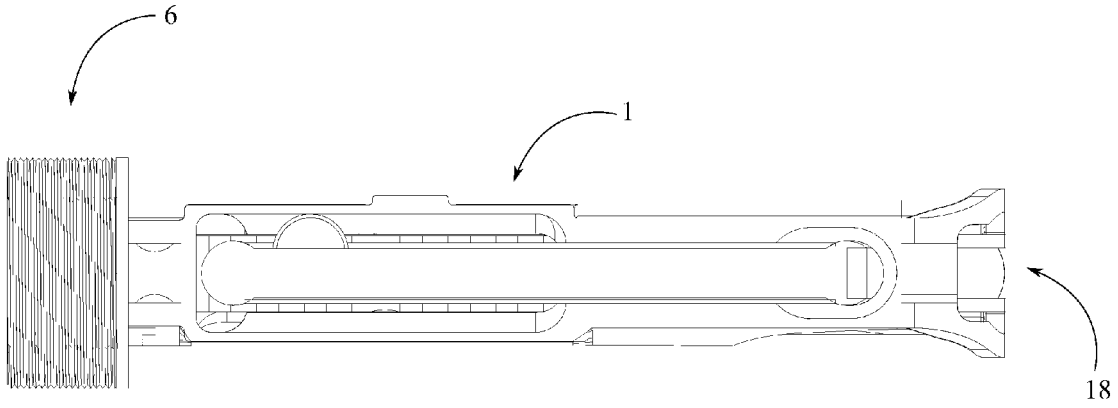
FIG. 7 is a bottom view of the present invention.

The tubular body 7 shown in FIG. 4 receives the AR-15 gun barrel. The tubular body 7 comprises a front body surface 8, a rear body surface 9, an inner annular surface 10, and an outer annular surface 11. The rear body surface 9 is connected adjacent to the front housing base 2 such that the tubular body 7 can be considered an extension of the cylindrical housing 1.

The rear housing base 3 is the opposite end of the cylindrical housing 1. The stock mounting point 18 is positioned adjacent to the rear housing base 3.

The internal threading 14 is connected about the inner annular surface 10. Similarly, the external threading 15 is connected about the outer annular surface 11. The internal threading 14 is used to engage the threading of the barrel nut provided with the present invention. As a result, the AR-15 gun barrel can be secured within the internal threading 14. The external threading 15 engages with the internal threads found on any AR-15 hand guard, which allows the hand guard to be secured onto the external threading 15.

The radius of the hand guard is larger than the radius of the cylindrical housing 1. The larger radius of the hand guard traditionally corresponds to the external radius of the barrel nut. In order to substitute for the omitted barrel nut, and to receive the hand guard, the outer annular surface 11 is designed to be radially larger than the cylindrical housing 1.

Traditionally, the AR-15 gun barrel is aligned with the upper receiver by means of a pin located on the AR-15 gun barrel. Since the AR-15 gun barrel is inserted into the tubular body 7, the pin locking slot 13 is placed within the inner annular surface 10. More specifically, the pin locking slot 13 perpendicularly traverses into the inner annular surface 10. The pin locking slot 13 is positioned from the front body surface 8 to the rear body surface 9 such that the entire pin is completely secured.

The gas system of an AR-15 usually traverses the barrel nut. However, since the traditional barrel nut is omitted in the present invention, the tubular body 7 is provided with a means to receive the gas tube. In particular, the gas tube slot 12 traverses through the tubular body 7 from the front body surface 8 to the rear body surface 9 and traverses into the cylindrical housing 1.

In the preferred embodiment of the present invention, the gas tube slot 12 is positioned about the tubular body 7 adjacent to the top lateral surface 4. Similarly, the pin locking slot 13 is also positioned about the tubular body 7 to align adjacent to the top lateral surface 4. The positioning of the gas tube slot 12 and the pin locking slot 13 are illustrated in FIG. 2.

As seen in many upper receivers, the top lateral surface 4 comprises a Picatinny-style rail 19. More specifically, the Picatinny-style rail 19 is connected along the top lateral surface 4 so that different accessories such as night vision riflescopes can be attached. The Picatinny-style rail 19 has a dovetail-shaped cross section so that the mounted accessories are locked in position. Furthermore, accessories that were designed to mount on weaver-style rails can also be mounted onto the Picatinny-style rail 19.

The upper receiver is connected to the lower receiver with a first lower-receiver attachment point 16 and a second lower-receiver attachment point 17. The first lower-receiver attachment point 16 and the second lower-receiver attachment point 17 are positioned opposite to each other along the bottom lateral surface 5. Furthermore, the first lower-receiver attachment point 16 and the second lower-receiver attachment point 17 are connected adjacent to the bottom lateral surface 5 and also positioned in parallel to each other. The first lower-receiver attachment point 16 and the second lower-receiver attachment point 17 each comprise a hole. The takedown pins of the AR-15 traverses the first lower-receiver attachment point 16 and the second lower-receiver attachment point 17 allowing the upper receiver to be secured with the lower receiver.

As seen in FIG. 2, the inner annular surface 10 and the outer annular surface 11 are concentrically positioned to each other. As a result, the internal threading 14 and the external threading 15 are also concentrically positioned with each other so that the AR-15 gun barrel and the hand guard are also positioned concentrically. Moreover, the tubular body 7 and the cylindrical housing 1 are concentric to each other such that the overall shape of an AR-15 semi-automatic rifle does not change.

The redesigned upper receiver is additionally provided with a chromed side charger carrier, two barrel nuts, a free float hand guard with a lock ring, and a spanner wrench for the barrel nut. When installing the present invention onto the AR-15 gun, the user executes the following assembly process. Foremost, a provided barrel nut is inserted into the barrel assembly. After the barrel nut is inserted, the barrel assembly is positioned within the inner annular surface 10. The barrel assembly is positioned such that the barrel pin is secured in the pin locking slot 13. Simultaneously, the gas tube is secured in the gas tube slot 12. Next, the barrel nut is secured within the internal threading 14 and is hand tightened and also tightened with the provided spanner wrench. Next, the charge carrier is inserted through the rear housing base 2 of the upper receiver and placed in its particular slot. Upon completion, the hand guard is installed on to the upper receiver. The hand guard is slid over the AR-15 gun barrel and placed over the outer annular surface 11. Next, the hand guard threading is engaged to the external threading 15. When the AR-15 gun barrel is installed, the upper receiver is connected to the lower receiver with the first lower-receiver attachment point 16 and the second lower-receiver attachment point 17.

Although the invention has been explained in relation to its preferred embodiment, it is to be understood that many other possible modifications and variations can be made without departing from the spirit and scope of the invention as hereinafter claimed.

What is claimed is:

1. A redesigned semi-automatic rifle upper receiver comprises:

a cylindrical housing;

a barrel mount;

a stock mounting point;

the cylindrical housing comprises a front housing base, a rear housing base, a top lateral surface, and a bottom lateral surface;

the barrel mount comprises a tubular body, a gas tube slot, a pin locking slot, an internal threading, and an external threading;

the tubular body comprises a front body surface, a rear body surface, an inner annular surface, and an outer annular surface;

the rear body surface being connected adjacent to the front housing base;

the stock mounting point-being positioned adjacent to the rear housing base;

the internal threading being connected about the inner annular surface;

the external threading being connected about the outer annular surface;

the pin locking slot perpendicularly traversing into the inner annular surface;

the pin locking slot being positioned from the front body surface to the rear body surface;

the gas tube slot traversing through the tubular body from the front body surface to the rear body surface and traversing into the cylindrical housing;

a radius of the outer annular surface being larger than a radius for the cylindrical housing;

the housing base comprises a "C" shaped cross section at a first end and a circular cross section at a second end;

the housing base comprising a "J" shaped rib at the first end;

the top lateral surface positioned at the first end;

an angled surface extends from an end of the top lateral surface;

a first lower-receiver attachment point;

a second lower-receiver attachment point;

the first lower-receiver attachment point and the second lower-receiver attachment point being positioned opposite to each other along the bottom lateral surface;

the first lower-receiver attachment point and the second lower-receiver attachment point being connected adjacent to the bottom lateral surface;

the first lower-receiver attachment point and the second lower-receiver attachment point being positioned parallel to each other;

the first lower-receiver attachment point positioned at the second end;

the second lower-receiver attachment point comprising a first through hole extending perpendicular to a length of the housing;

the second lower-receiver attachment point positioned at the first end; and the second lower-receiver attachment point comprising a second through hole extending perpendicular to the length of the housing.

2. The redesigned semi-automatic rifle upper receiver as claimed in 1 comprises:

the gas tube slot being positioned about the tubular body to align adjacent to the top lateral surface.

3. The redesigned semi-automatic rifle upper receiver as claimed in 1 comprises:

the pin locking slot being positioned about the tubular body to align adjacent to the top lateral surface.

4. The redesigned semi-automatic rifle upper receiver as claimed in 1 comprises:

a Picatinny-style rail;

the Picatinny-style rail being connected along the top lateral surface; and the Picatinny-style rail being a dovetail-shaped cross section.

5. The redesigned semi-automatic rifle upper receiver as claimed in 1 comprises:

the inner annular surface and the outer annular surface being concentrically positioned with each other; and the internal threading and the external threading being concentrically positioned with each other.

6. The redesigned semi-automatic rifle upper receiver as claimed in 1 comprises:

the tubular body and the cylindrical housing being concentrically positioned with each other.

7. A redesigned semi-automatic rifle upper receiver comprises:

a cylindrical housing;

a barrel mount;

a stock mounting point;

the cylindrical housing comprises a front housing base, a rear housing base, a top lateral surface, and a bottom lateral surface;

the barrel mount comprises a tubular body, a gas tube slot, a pin locking slot, an internal threading, and an external threading;

the tubular body comprises a front body surface, a rear body surface, an inner annular surface, and an outer annular surface;

the rear body surface being connected adjacent to the front housing base;

the stock mounting point- being positioned adjacent to the rear housing base;

the internal threading being connected about the inner annular surface;

the external threading being connected about the outer annular surface;

the pin locking slot perpendicularly traversing into the inner annular surface;

the pin locking slot being positioned from the front body surface to the rear body surface;

the gas tube slot traversing through the tubular body from the front body surface to the rear body surface and traversing into the cylindrical housing;

a radius of the outer annular surface being larger than a radius for the cylindrical housing;

the gas tube slot being positioned about the tubular body to align adjacent to the top lateral surface;

the pin locking slot being positioned about the tubular body to align adjacent to the top lateral surface;

the housing base comprises a "C" shaped cross section at a first end and a circular cross section at a second end;

the housing base comprising a "J" shaped rib at the first end;

the top lateral surface positioned at the first end;

an angled surface extends from an end of the top lateral surface;

a first lower-receiver attachment point;

a second lower-receiver attachment point;

the first lower-receiver attachment point and the second lower-receiver attachment point being positioned opposite to each other along the bottom lateral surface;

the first lower-receiver attachment point and the second lower-receiver attachment point being connected adjacent to the bottom lateral surface;

the first lower-receiver attachment point and the second lower-receiver attachment point being positioned parallel to each other;

the first lower-receiver attachment point positioned at the second end;

the second lower-receiver attachment point comprising a first through hole extending perpendicular to a length of the housing;

the second lower-receiver attachment point positioned at the first end; and the second lower-receiver attachment point comprising a second through hole extending perpendicular to the length of the housing.

8. The redesigned semi-automatic rifle upper receiver as claimed in 7 comprises:

a Picatinny-style rail;

the Picatinny-style rail being connected along the top lateral surface; and the Picatinny-style rail being a dovetail-shaped cross section.

9. The redesigned semi-automatic rifle upper receiver as claimed in 7 comprises:

the inner annular surface and the outer annular surface being concentrically positioned with each other; and the internal threading and the external threading being concentrically positioned with each other.

10. The redesigned semi-automatic rifle upper receiver as claimed in 7 comprises:

the tubular body and the cylindrical housing being concentrically positioned with each other.

11. A method of assembling a semi-automatic rifle upper receiver onto a gun, comprising:

providing a gun comprising a barrel assembly, the barrel assembly comprising a barrel providing a semi-automatic rifle upper receiver, comprising:

a cylindrical housing;

a barrel mount;

a stock mounting point;

a Picatinny-style rail;

the cylindrical housing comprises a front housing base, a rear housing base, a top lateral surface, and a bottom lateral surface;

the barrel mount comprises a tubular body, a gas tube slot, a pin locking slot, an internal threading, and an external threading;

the tubular body comprises a front body surface, a rear body surface, an inner annular surface, and an outer annular surface;

the rear body surface being connected adjacent to the front housing base;

the stock mounting point-being positioned adjacent to the rear housing base;

the internal threading being connected about the inner annular surface;

the external threading being connected about the outer annular surface;

the pin locking slot perpendicularly traversing into the inner annular surface;

the pin locking slot being positioned from the front body surface to the rear body surface;

the gas tube slot traversing through the tubular body from the front body surface to the rear body surface and traversing into the cylindrical housing;

a radius of the outer annular surface being larger than a radius for the cylindrical housing;

the gas tube slot being positioned about the tubular body to align adjacent to the top lateral surface;

the pin locking slot being positioned about the tubular body to align adjacent to the top lateral surface;

the Picatinny-style rail being connected along the top lateral surface;

the Picatinny-style rail being a dovetail-shaped cross section;

a first lower-receiver attachment point;

a second lower-receiver attachment point;

the first lower-receiver attachment point and the second lower-receiver attachment point being positioned opposite to each other along the bottom lateral surface;

the first lower-receiver attachment point and the second lower-receiver attachment point being connected adjacent to the bottom lateral surface;

the first lower-receiver attachment point and the second lower-receiver attachment point being positioned parallel to each other;

the inner annular surface and the outer annular surface being concentrically positioned with each other;

the internal threading and the external threading being concentrically positioned with each other;

the tubular body and the cylindrical housing being concentrically positioned with each other; providing a chromed side charge carrier, two barrel nuts, a free float hand guard lock ring, and a spanner wrench; inserting one of said two barrel nuts into the barrel assembly; positioning the barrel assembly within the inner annular surface; securing the barrel pin within the pin locking slot; securing the gas tube into the gas tube slot; securing the other of said two barrel nuts within the internal threading by hand and/or with the spanner wrench; inserting the charge carrier through the rear housing base of the upper receiver; installing the hand guard onto the upper receiver by sliding the hand guard over the barrel and over the outer annular surface; and threading the hand guard onto the external threading.

* * * * *